US011427009B2

(12) United States Patent
Mori et al.

(10) Patent No.: US 11,427,009 B2
(45) Date of Patent: Aug. 30, 2022

(54) IMAGE FORMATION DEVICE

(71) Applicant: BROTHER KOGYO KABUSHIKI KAISHA, Nagoya (JP)

(72) Inventors: Shumei Mori, Ichinomiya (JP); Yohei Kuno, Nagoya (JP); Sho Mishima, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/828,363

(22) Filed: Mar. 24, 2020

(65) Prior Publication Data

US 2020/0307231 A1 Oct. 1, 2020

(30) Foreign Application Priority Data

Mar. 25, 2019 (JP) ..... JP2019-056909

(51) Int. Cl.
*B41J 2/175* (2006.01)
*B41J 2/17* (2006.01)

(52) U.S. Cl.
CPC ..... *B41J 2/17523* (2013.01); *B41J 2/1707* (2013.01); *B41J 2/17509* (2013.01); *B41J 2/17566* (2013.01); *B41J 2/17596* (2013.01)

(58) Field of Classification Search
CPC .. B41J 2/17523; B41J 2/17596; B41J 2/1707; B41J 2/17566; B41J 2/17509
See application file for complete search history.

(56) References Cited

U.S. PATENT DOCUMENTS 5,382,969 A * 1/1995 Mochizuki ..... B41J 2/1652 347/23
5,451,987 A 9/1995 Perrin
6,224,201 B1 * 5/2001 Shigemura ..... B41J 2/195 347/93
7,182,444 B2 2/2007 Kawamoto
2004/0066432 A1 4/2004 Hatada et al.
2005/0046682 A1 3/2005 Kawamoto
2009/0189931 A1 7/2009 Noro et al.
2011/0050766 A1 3/2011 Matsumoto et al.
2012/0262523 A1 10/2012 Yaakov et al.
2013/0286120 A1 * 10/2013 Kobayashi ..... B41J 2/17509 347/102
2018/0345675 A1 * 12/2018 Kawagoe ..... B41J 2/17553
(Continued)

FOREIGN PATENT DOCUMENTS

JP S59-232734 A 12/1984
JP H4-501987 A 4/1992
(Continued)

OTHER PUBLICATIONS

Non-Final Office Action dated May 18, 2021 in related U.S. Appl. No. 16/828,347.
(Continued)

*Primary Examiner* — Justin Seo
(74) *Attorney, Agent, or Firm* — K&L Gates LLP

(57) ABSTRACT

The image formation device includes a tank, a hollow member, and a sensor. The tank is configured to store ink. The hollow member is disposed inside the tank, and extends in an up-down direction. The sensor is disposed outside the tank and above the hollow member, and is configured to detect a pressure inside the hollow member.

14 Claims, 14 Drawing Sheets

(56) References Cited

U.S. PATENT DOCUMENTS

| | | | | |
|---|---|---|---|---|
| 2019/0193408 | A1* | 6/2019 | Kuno | B41J 2/17523 |
| 2019/0202208 | A1* | 7/2019 | Haines | B41J 2/175 |

FOREIGN PATENT DOCUMENTS

| | | | |
|---|---|---|---|
| JP | H11-042795 | A | 2/1999 |
| JP | 2005067122 | A | 3/2005 |
| JP | 2006-327097 | A | 12/2006 |
| JP | 4191972 | A | 12/2008 |
| JP | 4191972 | B2 | 12/2008 |
| JP | 2009-202565 | A | 9/2009 |
| JP | 2010-240509 | A | 10/2010 |
| JP | 2013-086440 | A | 5/2013 |
| JP | 2014-091241 | A | 5/2014 |
| JP | 2014-097616 | A | 5/2014 |
| JP | 2015-112724 | A | 6/2015 |

OTHER PUBLICATIONS

New U.S. patent application claiming priority to JP Application No. 2019-056879, being filed concurrently with the United States Patent and Trademark Office.

Japanese Office Action dated Feb. 22, 2022, Japanese application No. 2019-056879 (6 pages), which corresponds to U.S. Appl. No. 16/828,347, which relates to the instant application.

* cited by examiner (a)

(b)

IMAGE FORMATION DEVICE

CROSS-REFERENCE TO RELATED APPLICATION

This application claims priority to Japanese Patent Application No. 2019-056909 filed on Mar. 25, 2019, the disclosure of which is herein incorporated by reference in its entirety.

BACKGROUND

The present disclosure relates to an image formation device.

An inkjet printer is known that detects a remaining amount of ink. For example, the inkjet printer is provided with an ink tank and an immersed electrode. The ink tank stores ink. The immersed electrode is provided inside the ink tank, and the remaining amount of the ink stored in the ink tank is detected in a state in which the electrode is immersed in the ink.

Further, an inkjet recording device is known that detects leakage of ink. For example, the inkjet recording device is provided with a buffer tank, an overflow tank and a float sensor. The buffer tank stores ink. The overflow tank stores the ink flowing from the buffer tank. The float sensor is provided inside the overflow tank, and detects the leakage of the ink inside the overflow tank.

SUMMARY

In the above-described inkjet printer, since the immersed electrode is immersed in the ink, the ink may adhere to the surface of the electrode and the conductivity of the electrode may deteriorate. As a result, the immersed electrode may deteriorate. Further, in the above-described inkjet recording device, a float of the float sensor may stop moving as a result of the ink adhering between the float and a shaft. This may result in a sensing failure of the float sensor.

Various embodiments of the general principles described herein provide an image formation device which is capable of inhibiting deterioration of a detection sensor used to detect a remaining amount of ink, and which is also capable of suppressing a sensing failure.

Embodiments herein provide an image formation device that includes a tank, a hollow member, and a sensor. The tank is configured to store ink. The hollow member is disposed inside the tank and extends in an up-down direction. The sensor is disposed outside the tank and above the hollow member, and is configured to detect a pressure inside the hollow member.

BRIEF DESCRIPTION OF THE DRAWINGS

Embodiments will be described below in detail with reference to the accompanying drawings in which:

FIG. 7 is a lateral cross-sectional view of the main tank along a line VII-VII in

FIG. 3;

DETAILED DESCRIPTION

Hereinafter, as an example of the liquid storage device of the present disclosure, a printer 1 will be explained with reference to the drawings. The upward direction, the downward direction, the left downward direction, the right upward direction, the right downward direction and the left upward direction in FIG. 1 respectively correspond to an upward direction, a downward direction, a front direction, a rear direction, a right direction and a left direction of the printer 1.

Figure 2:
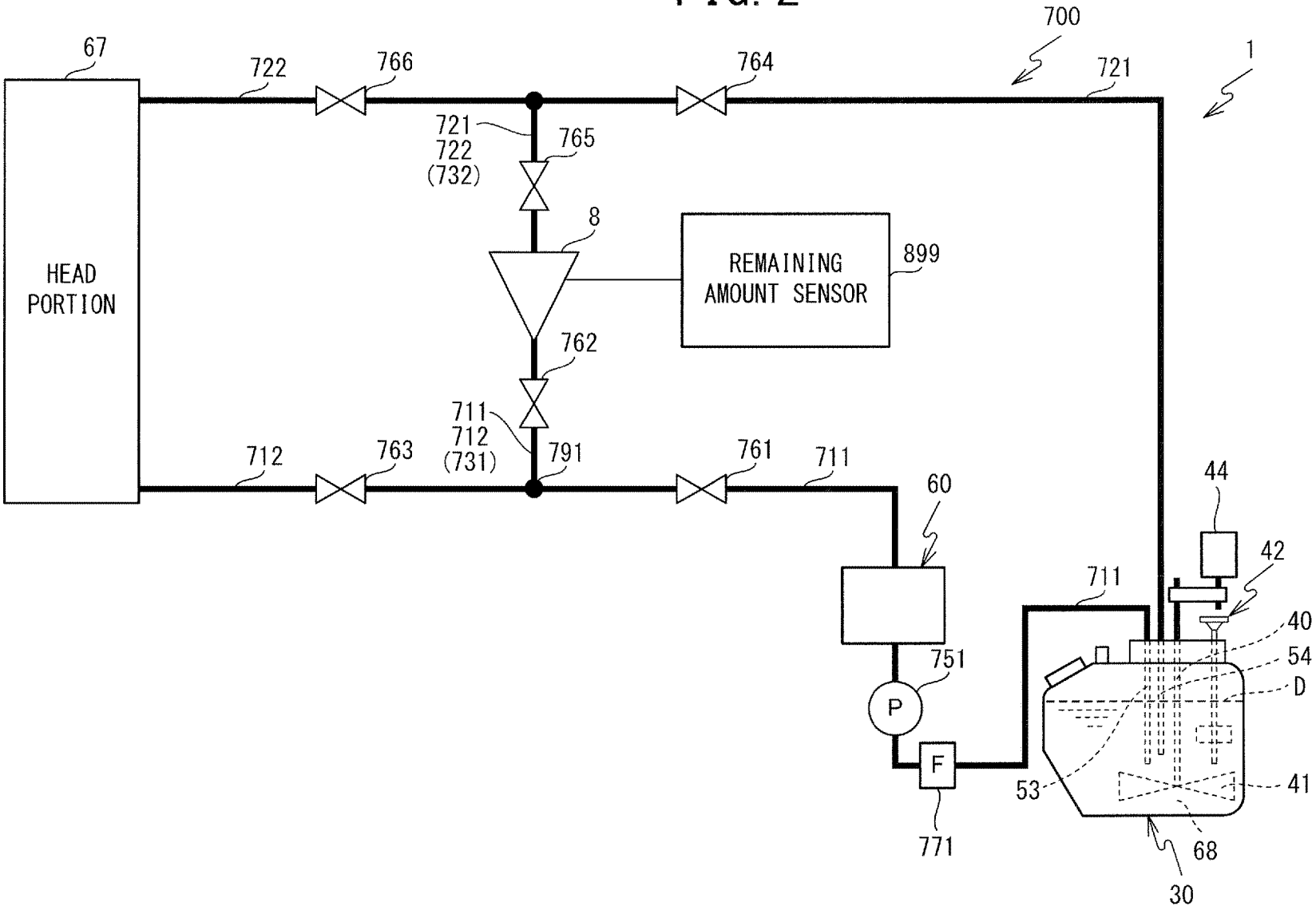
FIG. 2 is a diagram schematically showing a configuration of the printer.

The printer 1 is an inkjet printer that performs printing on a fabric such as a T-shirt, or a recording medium such as paper, by ejecting an ink 68 (refer to FIG. 2) from nozzles of a head portion 67 (refer to FIG. 2). The printer 1 prints a color image on the recording medium by downwardly ejecting, for example, five different types (white (W), black (K), yellow (Y), cyan (C) and magenta (M)) of the ink 68. In the following explanation, of the five types of the ink 68, the white ink 68 is referred to as white ink. The four colors of the ink 68, i.e., the black, cyan, yellow and magenta inks, are collectively referred to as color inks. The white ink is an ink having higher settleability than the color inks.

Figure 1:
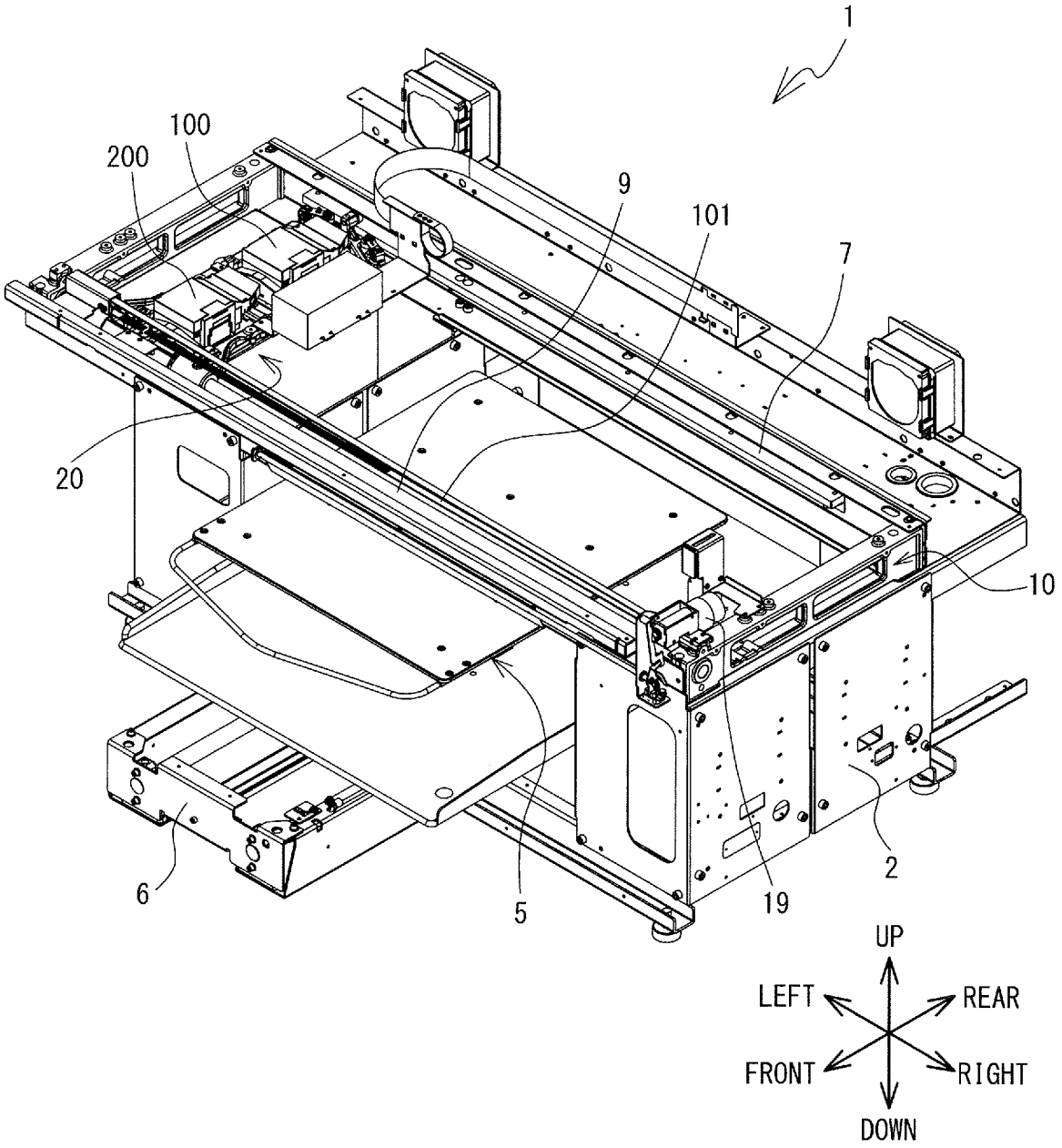
FIG. 1 is a perspective view of a printer.

As shown in FIG. 1, the printer 1 is provided with a housing 2, a platen drive mechanism 6, a pair of guide rails (not shown in the drawings), a platen 5, a frame body 10, a guide shaft 9, a rail 7, a carriage 20, head units 100 and 200, a drive belt 101, and a drive motor 19. An operation buttons 501 (refer to FIG. 8) are provided at a front position on the right side of the housing 2. The operation buttons 501 are operated when an operator inputs commands relating to various operations of the printer 1.

The frame body 10 has a substantially rectangular frame shape in a plan view, and is installed on an upper portion of the housing 2. The front side of the frame body 10 supports the guide shaft 9, and the rear side of the frame body 10 supports the rail 7. The guide shaft 9 extends in the left-right direction on the inside of the frame body 10. The rail 7 is disposed facing the guide shaft 9 and extends in the left-right direction.

The carriage 20 is supported such that the carriage 20 can be conveyed in the left-right direction along the guide shaft 9. The head units 100 and 200 are mounted on the carriage 20 such that the head units 100 and 200 are aligned in the front-rear direction. The head unit 100 is positioned further to the rear than the head unit 200. The head portion 67 (refer to FIG. 2) is provided on a lower portion of each of the head units 100 and 200. The head portion 67 of the head unit 100 ejects the white ink. The head portion 67 of the head unit 200 ejects the color inks. The head portion 67 is provided with a surface having a plurality of fine nozzles (not shown in the drawings) that can eject the ink 68 downward.

As shown in FIG. 1, the drive belt 101 is stretched along the left-right direction on the inside of the frame body 10. The drive motor 19 is coupled to the carriage 20 via the drive belt 101. When the drive motor 19 drives the drive belt 101, the carriage 20 is caused to reciprocate in the left-right direction along the guide shaft 9.

The platen drive mechanism 6 is provided with the pair of guide rails (not shown in the drawings) and a platen support base (not shown in the drawings). The pair of guide rails extend in the front-rear direction on the inside of the platen drive mechanism 6, and support the platen support base such that the platen support base can move in the front-rear direction. An upper portion of the platen support base supports the platen 5. The platen 5 supports the recording medium. The platen drive mechanism 6 is driven by a sub-scanning drive portion 63 (refer to FIG. 8), and moves the platen support base and the platen 5 along the pair of guide rails in the front-rear direction. Printing by the printer 1 on the recording medium is performed by the platen 5 conveying the recording medium in the front-rear direction (a sub-scanning direction) and the ink 68 being ejected from the head portion 67 that is reciprocating in the left-right direction (a main scanning direction).

As shown in FIG. 2 which shows the schematics of printer 1, the printer 1 is provided with a CPU11, and an ink supply portion 700. The CPU11 controls the printer 1 in accordance with a control program. The ink supply portion 700 supplies the white ink 68 to the head portion 67 of the head unit 100. The head portion 67 is provided with an inkjet head. An ink supply portion (not shown in the drawings) that supplies each of the four color inks 68 to the head portion 67 of the head unit 200 may also have a configuration similar to that shown in FIG. 2. Below, a configuration relating to the white ink 68 will be explained.

As shown in FIGS. 2 to 7, the printer 1 is provided with a main tank 30, a shaft 40, an agitation blade 41, a first tube 53, a second tube 54, fixing member 52, a pressure detection sensor 42, a hollow member 58, and an agitation motor 44. The main tank 30 stores the ink 68. The ink 68 stored in the main tank 30 is supplied to the ink supply portion 700, and the ink 68 returning from the ink supply portion 700 is stored once more in the main tank 30. An amount that can be stored in the main tank 30 is greater than an amount that can be stored in a sub pouch 8 to be described later. The agitation motor 44 rotates the shaft 40. The ink 68 is agitated by the agitation blade 41 rotating due to the rotation of the shaft 40.

The first tube 53 is connected to a first supply flow path 711 to be described later, and supplies the ink 68 in the main tank 30 to the head portion 67. The first tube 53 is connected to a first supply flow path 711 to be described later, and supplies the ink 68 inside the main tank 30 to the head portion 67. In a state before being attached to the main tank 30, the first tube 53 has a straight line shape, as shown by alternate long and double-short dash lines in FIG. 5. In a state of being attached to the main tank 30, the first tube 53 is fixed using the fixing member 52 to be described later, such that the first tube 53 has a curved line shape, as shown by solid lines in FIG. 5. In this way, in the state in which the first tube 53 is attached to the main tank 30, the first tube 53 is curved, and thus, a direction in which the leading end portion of the first tube 53 extends changes. However, the first tube 53 is configured by a material such that, when the first tube 53 is removed from the main tank 30, the first tube 53 returns to a substantially straight line shape. In other words, a shape does not become fixed of a section over which the direction in which the leading end portion of the first tube 53 extends changes.

Figure 6:
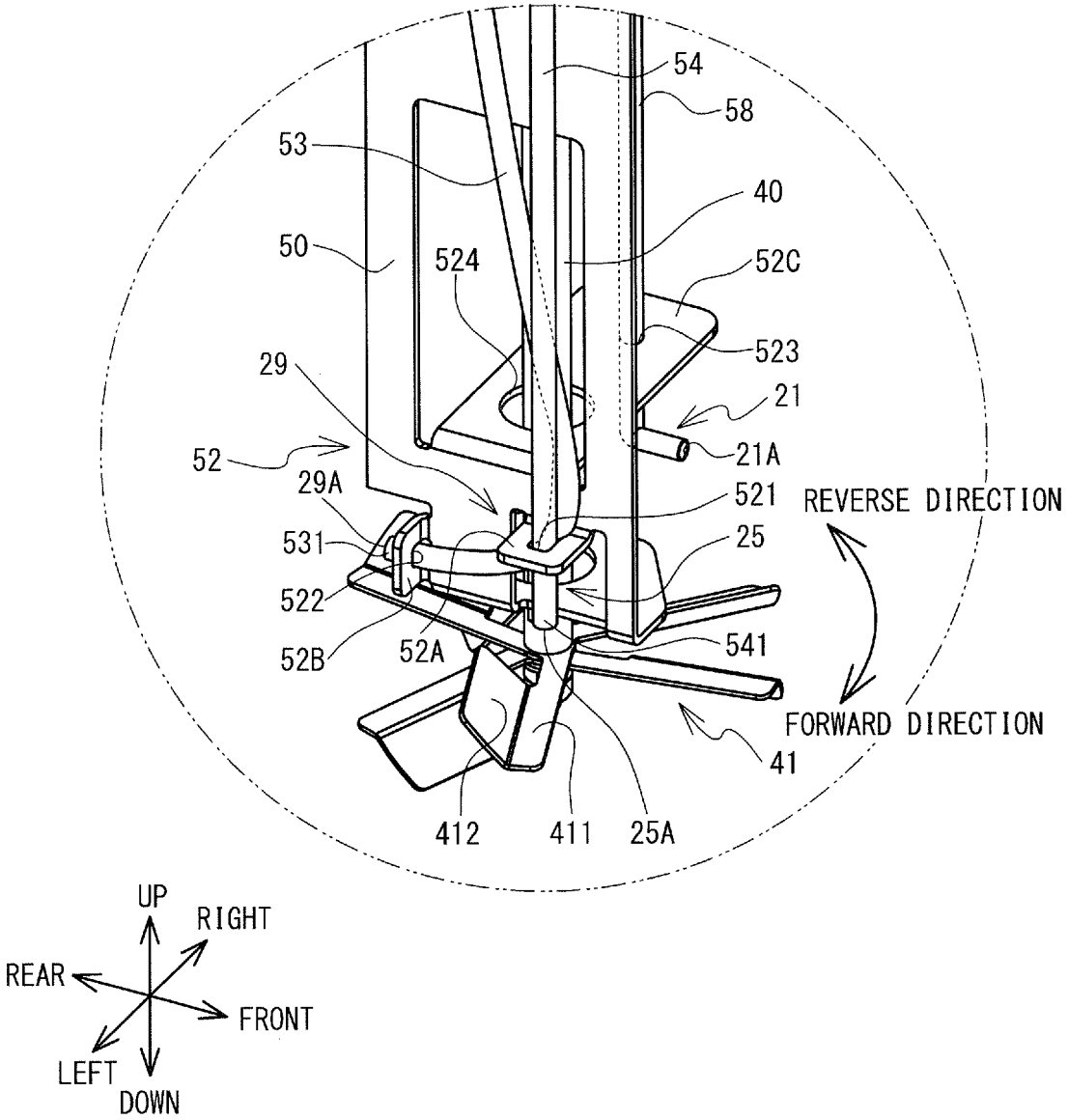
FIG. 6 is an enlarged perspective view of the lower end portion that is inside the main tank.

The second tube 54 is connected to a first circulation flow path 721 to be described later, and returns the ink 68 to the main tank 30. As shown in FIG. 6, an opening portion 29A of a lower end portion 29 of the first tube 53 vertically intersects an axial line of the lower end portion 29. An opening portion 25A of a lower end portion 25 of the second tube 54 vertically intersects an axial line of the lower end portion 25. The fixing member 52 fixes positions of the first tube 53, the second tube 54, and the hollow member 58. The pressure detection sensor 42 detects a pressure inside the hollow member 58.

[Main Tank 30]

Figure 3:
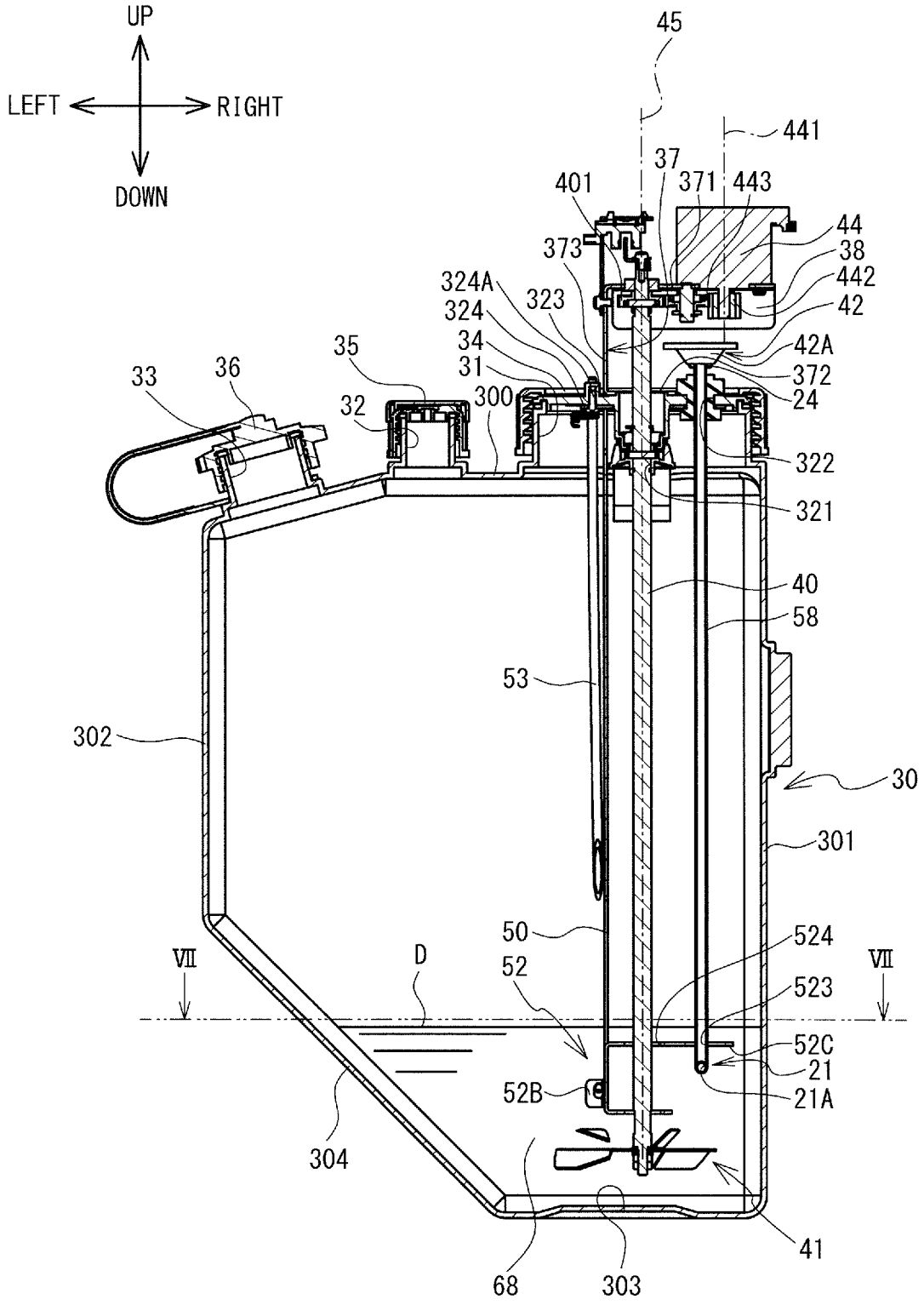
FIG. 3 is a vertical cross-section of a main tank.
Figure 4:
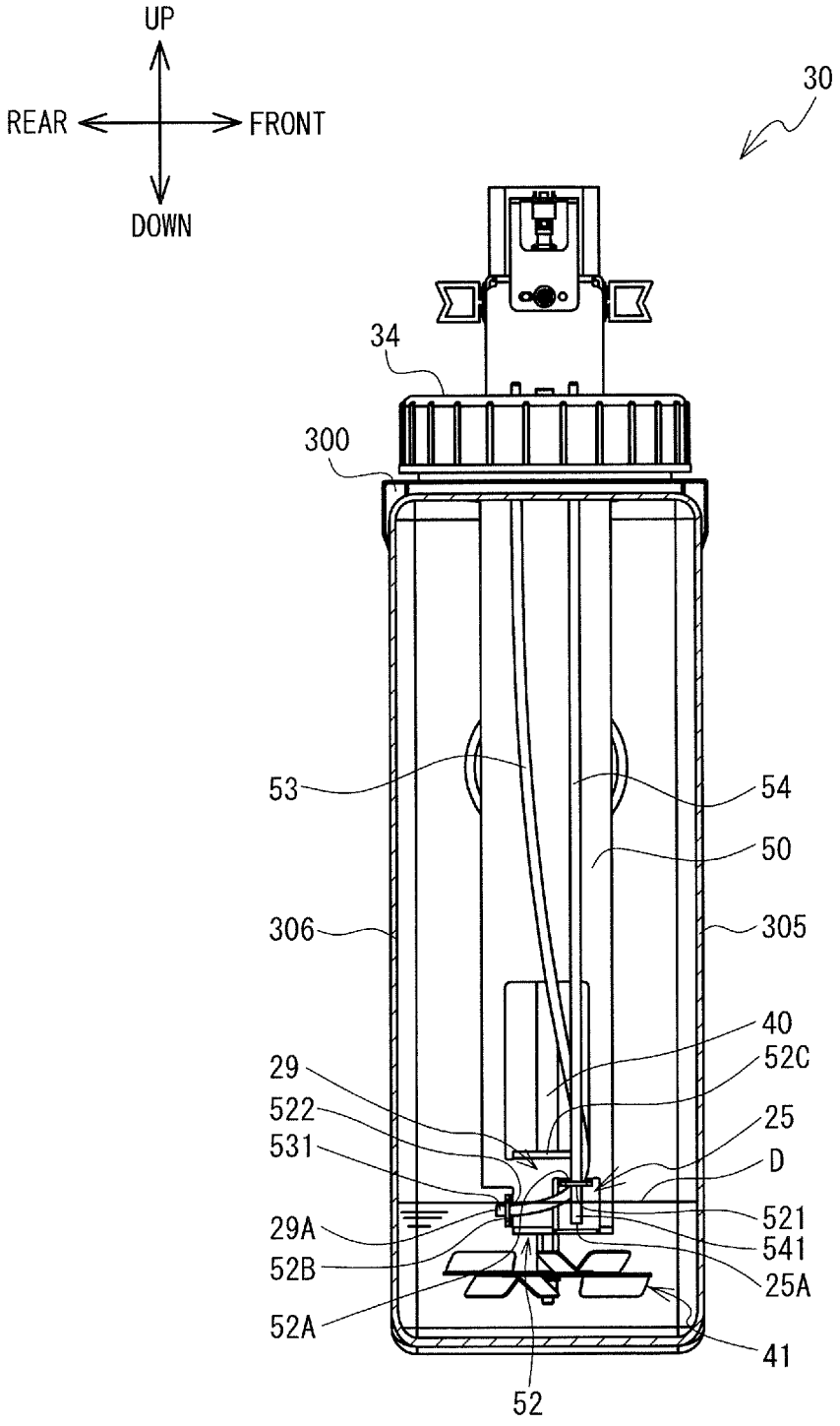
FIG. 4 is a vertical cross-sectional view of the main tank, along a surface orthogonal to the vertical cross-sectional view shown in FIG. 3.

As shown in FIG. 3, the main tank 30 is provide with an upper portion 300, a bottom portion 303, a right side surface 301, a left side surface 302, and an inclined surface 304. The left side surface 302 is shorter than the right side surface 301 in the up-down direction, and a position of the lower end portion of the left side surface 302 is higher than a position of the lower end portion of the right side surface 301. The inclined surface 304 connects the lower end portion of the left side surface 302 and the left end portion of the bottom portion 303. As shown in FIG. 4, the main tank 30 is provided with a front surface 305 and a rear surface 306.

As shown in FIG. 3, a supply opening portion 31, a supply opening portion 32, and a supply opening portion 33 are provided in the upper portion 300, and are respectively closed by a lid 34, a lid 35, and a lid 36. When filling the main tank 30 with the ink 68, the lid 36 is removed, and the ink 68 is supplied into the main tank 30 from the supply opening portion 33.

An insertion hole 321, an insertion hole 322, and an insertion hole (not shown in the drawing) are provided in the lid 34. The shaft 40 is inserted inside the main tank 30 from the insertion hole 321. The hollow member 58 that supports the pressure detection sensor 42 is fixed to the insertion hole 322. A fixing member 324 is provided in the insertion hole. The fixing member 324 is internally provided with an through hole (not shown in the drawings), and a screw portion 324A is formed in an upper portion of the fixing member 324. The fixing member 324 is fixed to the insertion hole 323 of the lid 34 by the screw portion 324A. The first tube 53 and the second tube 54 are fixed to the through hole on the internal side in the fixing member 324, and are inserted inside the main tank 30.

[Shaft 40 and the Agitation Blade 41]

The shaft 40 extends in the up-down direction, and rotates around an axial line 45. The agitation blade 41 is connected to the lower end portion of the shaft 40. Thus, the agitation blade 41 is provided on the side of the bottom portion 303 inside the main tank 30, namely lower side of the main tank 30. As shown in the FIGS. 6 and 7, the agitation blade 41 is provided with a plurality of the axis portion 411 that extends equally separated each other and is provided with the wing portion 412 that is separately fixed to the each of the axis portion 411. The shape of the wing portion 412 may preferably be a shape that can send the ink 68 to the upper portion 300 side by the rotation of the shaft 40 i.e. an inclined shape.

A frame 37 is provided above the lid 34. The frame 37 is provided with an upper wall 371, a lower wall 372, and a right wall 373. The upper wall 371 and the lower wall 372 extend in parallel to each other while being separated from each other in the up-down direction by a predetermined interval, and are connected to each other by the right wall 373. The frame 37 rotatably supports the shaft 40. The motor support base 38 is provided with the upper wall 371. The motor support base 38 support the agitation motor 44. An axis portion 411 of the agitation motor 44 protrudes downwardly and penetrates the motor support base 38. The gear 442 is fixed to the axis portion 411. Gear 401 is also fixed to the upper portion of the shaft 40. A gear 443 is disposed between the gear 442 and the gear 401, and meshes with the gear 442 and the gear 401. Therefore, shaft 40 rotates when the axis portion 411 of the agitation motor 44 rotates by the CPU11 control. The agitation blade 41 rotates by the rotation of the shaft 40. The agitation blade 41 can rotate in one direction, namely, in the clockwise direction in a plan view, which is a forward direction. When the agitation blade 41 rotates, the ink 68 stayed on the bottom portion 303 side moves toward the upper portion 300. Thus the possibility of settling the component of the ink in the main tank can be reduced.

[Hollow Member 58]

As shown in FIG. 3 to FIG. 7, the hollow member 58 is disposed inside the main tank 30. The hollow member 58 is configured by an upper side and a lower side 21, and is L-shaped (refer to FIG. 6) when viewed form the left side. The upper side of the hollow member 58 extends in the up-down direction, and the lower side 21 extends in the front-rear direction. The lower side 21 of the hollow member 58 extends in the front-rear direction orthogonal to the up-down direction. The hollow member 58 is formed of a gas barrier material. The lower side 21 of the hollow member 58 has the opening portion 21A.

[Fixing Member 52]

As shown in FIG. 6, the fixing member 52 fixes the position of the lower end portion 29 of the first tube 53, the lower end portion 25 of the second tube 54, and the lower side 21 of the hollow member 58. The fixing member 52 is provided with a plate-shaped portion 50, and position determining members 52A, 52B, and 52C. The plate-shaped portion 50 is a rectangular shape, the long sides of the plate-shaped portion 50 extending in the up-down direction along the shaft 40, and the short sides extending in the front-rear direction. The plate-shaped portion 50 is disposed between the shaft 40, and the first tube 53 and the second tube 54. The upper end portion of the plate-shaped portion 50 is fixed to the lid 34, using the screw portion 324A of the fixing member 324.

As shown in FIG. 4 and FIG. 6, the position determining member 52A of the fixing member 52 is a rectangular shape, and extends toward the left from in front of and below the lower end portion of the plate-shaped portion 50. The position determining member 52A has an elliptical opening 521 that penetrates in the up-down direction. The lower end portion 29 of the first tube 53 and the lower end portion 25 of the second tube 54 are inserted into the opening 521 of the position determining member 52A. The opening 521 of the position determining member 52A fixes the position of an upper end side of the lower end portion 29 of the first tube 53 and the lower end portion 25 of the second tube 54. That is, by the opening 521 of the position determining member 52A, the horizontal position of the first tube 53 is defined. Thus, the operator can easily performs the position determination in the horizontal direction in a case where the shape of the portion of the first tube 53 that changes the direction of the leading end portion of the first tube 53 is not fixed. The opening portion 25A of the lower end portion 25 of the second tube 54 is open downward.

The position determining member 52B of the fixing member 52 is positioned below and to the rear of the position determining member 52A. The position determining member 52B is a rectangular shape and extends toward the left from below and the rear of the lower end portion of the plate-shaped portion 50. The position determining member 52B has a circular opening 522 that penetrates in the front-rear direction. A lower end 531 of the first tube 53 is inserted into the opening 522 of the position determining member 52B. Specifically, the opening 522 of the position determining member 52B fixes the lower end portion 29 on the lower end 531 side, separately to the upper end side of the first tube 53. In this way, the lower end portion 29 of the first tube 53 extends in a direction intersecting the up-down direction, namely, to the rear and downward. That is, by the opening 522 of the position determining member 52B, the vertical position of the first tube 53 is defined. Thus, the operator can easily performs the position determination in the vertical direction in a case where the shape of the portion of the first tube 53 that changes the leading end portion of the first tube 53 is not fixed. The opening portion 29A of the lower end portion 29 of the second tube 54 is open downward. The opening portion 29A of the lower end portion 29 of the first tube 53 is open in the rearward direction.

As shown in FIG. 4, the lower end 531 of the first tube 53 is positioned above a lower end 541 of the second tube 54. The lower end portion 29 of the first tube 53 extends in a direction separating from the lower end portion 25 of the second tube 54.

The position determining member 52C is a rectangular shape and is provided on the lower end portion of the plate-shaped portion 50. On the lower end portion of the plate-shaped portion 50, the position determining member 52C extends to the right from above and the rear of the position determining member 52A. The position determining member 52C has circular openings 523 and 524 that penetrate in the up-down direction. The openings 523 and 524 are aligned side by side in the left-right direction. A lower side 21 of the hollow member 58 is inserted into the opening 523. The opening 523 fixes the position of the hollow member 58. Further, the shaft 40 is rotatably inserted into the opening 524.

Figure 7:
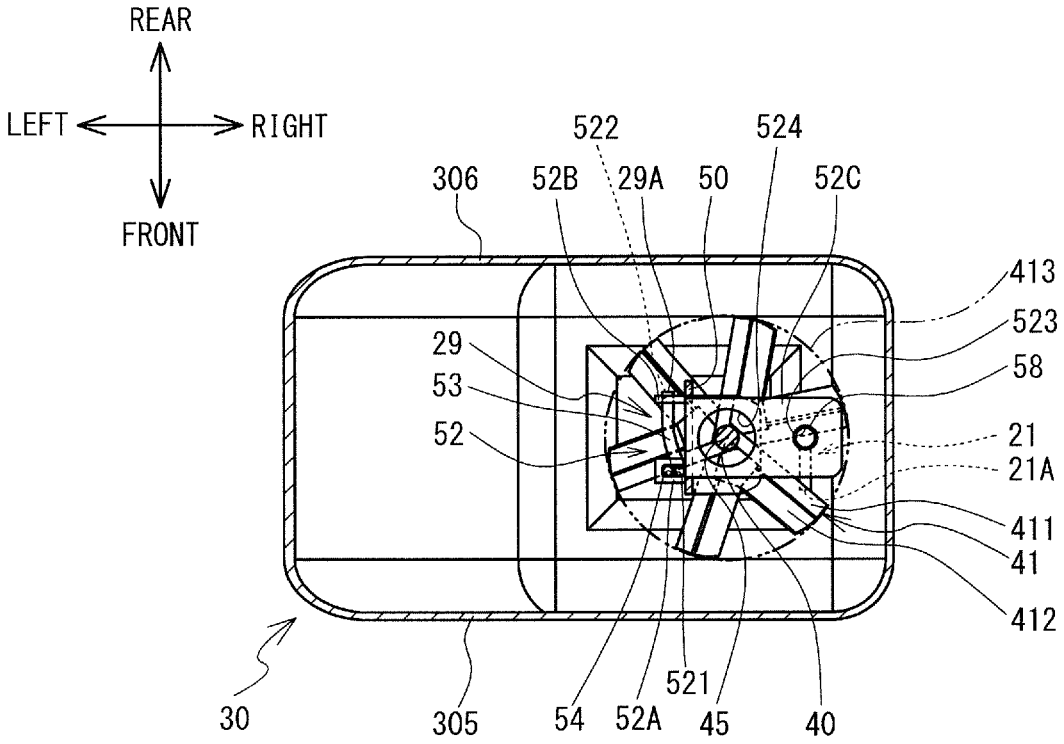

Positional relationships of the first tube 53, the second tube 54, the hollow member 58, and the fixing member 52 will be explained with reference to FIG. 4 to FIG. 7. As shown in FIG. 7, the fixing member 52 is disposed so as to overlap with a rotation area 413 of the agitation blade 41 in the up-down direction. For example, the rotation area 413 of the agitation blade 41 is an area within a circle whose radius is a distance from the axial line 45 of the shaft 40 to an outermost peripheral edge of the agitation blade 41. When seen from the up-down direction, the fixing member 52 is disposed in a position inside the rotation area 413.

The lower end portion 29 of the first tube 53 is disposed higher than the agitation blade 41. Further, the lower end portion 25 of the second tube 54 is disposed higher than the agitation blade 41. The opening portion 29A of the first tube 53 is disposed above the agitation blade 41. The opening portion 25A of the second tube 54 is disposed above the agitation blade 41. Note that, the opening portion 29A may not be positioned above the agitation blade 41.

The lower end portion 29 of the first tube 53 extends along the clockwise direction in a plan view, which is a rotation direction in which the agitation blade 41 rotates, and the opening portion 29A of the lower end portion 29 is open in the rearward direction, which is the rotation direction. The opening portion 25A of the lower end portion 25 of the second tube 54 is open downward.

The lower side 21 of the hollow member 58 extends along the rotation direction in which the agitation blade 41 rotates in the one direction, and the opening portion 21A is open in the frontward direction. Thus, the opening portion 21A extends toward a direction in which the ink 68 is agitated. As a result, even if the ink 68 contains air bubbles, the possibility of the air bubbles entering inside the hollow member 58 can be reduced.

As shown in FIG. 3, the fixing member 52, the first tube 53, and the second tube 54 are disposed between the hollow member 58 and the supply opening portion 33. The position determining member 52C of the fixing member 52 fixes the position of the hollow member 58 on the right side surface 301 side of the main tank 30, which is the opposite side to the supply opening portion 33 side. Thus, a possibility is reduced of the ink 68 supplied from the supply opening portion 33 directly hitting the opening portion 21A of the hollow member 58. As a result, the possibility can be reduced that the air bubble generated by supplying the ink 68 from the supply opening portion 33 flow into the hollow member 58 from the opening portion 21A.

[Pressure Detection Sensor 42]

As shown in FIG. 3, the pressure detection sensor 42 is disposed on the upper end of the hollow member 58. The pressure detection sensor 42 is provided with a case 42A, and a detection element (not shown in the drawings) used to detect pressure is housed in the case 42A. The detection element is disposed at the upper end of the hollow space of the hollow member 58. The pressure detection sensor 42 is provided so as to be separated from the ink 68 inside the main tank 30. The pressure detection sensor 42 detects the pressure inside the hollow space. The pressure detection sensor 42 detects a gauge pressure that can correct for fluctuations in atmospheric pressure. A sealing member 24 seals a apace between the hollow member 58 and the pressure detection sensor 42 (refer to FIG. 3) in order not to enter the air from the space between the hollow member 58 and pressure detection sensor 42. The sealing member 24 is a sealing member such as a packing, or the like.

The boundary between the gas and the ink 68 in the hollow space of the lower side 21 of the hollow member 58 moves in accordance with expansion and contraction of the gas inside the hollow space of the hollow member 58. Thus, it is desirable that the hollow member is provided such that the boundary between the air and the ink 68 is disposed in the lower side 21 of the hollow member 58 that extends in the front-rear direction. Further, the position of the boundary is achieved by determining the inner diameter and the material of the hollow member 58 in accordance with the surface tension of the ink 68 stored inside the main tank 30. Therefore, it is desirable that the cross section that is orthogonal to the axis direction of the hollow member 58 has a circular shape. The length of the inner diameter of the hollow member 58 is preferably 2 to 5 mm. The length of the lower side 21 is not limited to, however, 50 millimeter is preferable for a portion of the horizontal part of the lower side 21. The hollow member 58 can be made by resin material such as the polyethylene, the fluororesin, and the like. Also, ink 68 may include the at least one of the characteristic anionic surfactant and nonionic surfactant, and the surface tension may be equal to or more 20 [mN/m] and less than 36 [mN/m]. Ink 68 may not be limited to its components and colors, the ink 68 may be a white ink or the color ink. Even when the temperature of the gas changes and the gas positions inside of the hollow member 58 expands or contracts, a depth from the liquid surface of the ink 68 to the lower side 21 does not change. Thus, the printer 1 can reduce an influence on the pressure detection sensor 42 caused by temperature changes of the gas.

[Ink Supply Portion 700]

As shown in FIG. 2, the ink supply portion 700 is a portion that supplies and circulates the ink 68 to the head portion 67. The ink supply portion 700 is provided with the sub pouch 8, the first supply flow path 711, a second supply flow path 712, the first circulation flow path 721, a second circulation flow path 722, a first connection flow path 731, a second connection flow path 732, electromagnetic valves 761, 762, 763, 764, 765, and 766, a filter 771, a pump 751, and a deaeration module 60.

The sub pouch 8 stores the ink 68 supplied from the main tank 30, and supplies the ink 68 to the head portion 67. The head portion 67 ejects the ink 68 supplied from the sub pouch 8 and thus performs printing on a recording medium. A remaining amount sensor 899 is mounted on the sub pouch 8.

The first supply flow path 711, the second supply flow path 712, the first circulation flow path 721, the second circulation flow path 722, the first connection flow path 731, and the second connection flow path 732 are each formed by a tube, for example. The first supply flow path 711 connects to the first tube 53 and to the sub pouch 8, and is a flow path that supplies the ink 68 from the main tank 30 to the sub pouch 8.

The second supply flow path 712 connects to the sub pouch 8 and to the head portion 67, and is a flow path that supplies the ink 68 from the sub pouch 8 to the head portion 67. The first supply flow path 711 and the second supply flow path 712 converge at a first connection portion 791. The first connection flow path 731 is a flow path between the first connection portion 791 and the sub pouch 8.

The first circulation flow path 721 connects to the second tube 54 and to the sub pouch 8, and is a flow path to circulate the ink 68 from the sub pouch 8 to the main tank 30. The second circulation flow path 722 connects to the head portion 67 and to the sub pouch 8, and is a flow path to circulate the ink 68 from the head portion 67 to the sub pouch 8. The first circulation flow path 721 and the second circulation flow path 722 converge at a second connection portion 792. The second connection flow path 732 is a flow path between the second connection portion 792 and the sub pouch 8.

The electromagnetic valve 761 is provided in the first supply flow path 711. The electromagnetic valve 761 is positioned closer to the sub pouch 8 than a deaeration portion 601 to be described later. The electromagnetic valve 761 to 763 is respectively provided in the first supply flow path 711, the first connection flow path 731, the second supply flow path 712. The electromagnetic valve 761 to 763 is controlled by the CPU 11, and opens and closes the first supply flow path 711, first connection flow 731, the second supply flow path 712 respectively.

The electromagnetic valve 764 to 766 is provided in the first circulation flow path 721, second connection path 732, and the second circulation flow path 722 respectively. The electromagnetic valve 764 to 766 is controlled by the CPU 11, and opens and closes the first circulation flow path 721, second connection flown path 732 and second circulation flow path 722 respectively.

The filter 771 is provided in the first supply flow path 711. The pump 751 is provided in the first supply flow path 711. The pump 751 is provided closer to the sub pouch 8 than the filter 771. The pump 751 sucks up the ink 68 from the main tank 30 and causes the ink 68 to flow to the sub pouch 8 side, which is the downstream side. The deaeration module 60 is provided in the first supply flow path 711.

[Electrical Configuration]

Figure 8:
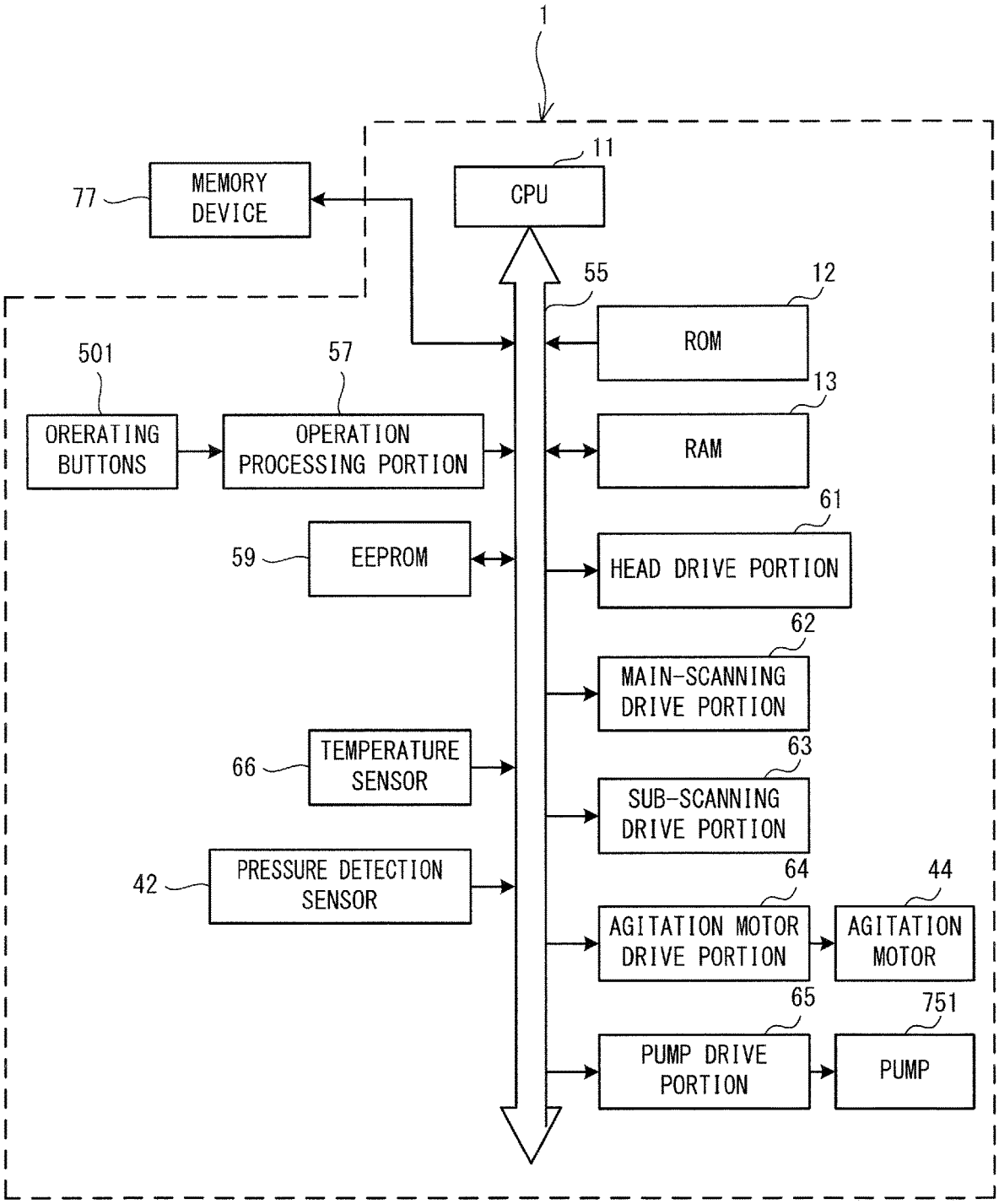
FIG. 8 is a block diagram showing an electrical configuration of the printer.

An electrical configuration of the printer 1 will be explained with reference to FIG. 8. As shown in FIG. 8, the printer 1 is provided with the CPU 11 as a control device performing control of the printer 1. A ROM 12, a RAM 13, EEPROMs 59, a head drive portion 61, a main scanning drive portion 62, a sub-scanning drive portion 63, an agitation motor drive portion 64, a pump drive portion 65, the pressure detection sensor 42, a temperature sensor 66, a memory device 77, and an operation processing portion 57 are electrically connected to the CPU 11 via a bus 55.

By executing a control program, for example, the CPU 11 forms an image on the recording medium using the ink 68 supplied from the main tank 30. The ROM 12 stores the control program used by the CPU 11 to control operations of the printer 1, initial values, and the like. The RAM 13 temporarily stores various data that are used in the control program. The EEPROM 59 holds and stores data regardless of whether a power source of the printer 1 is on or off. The head drive portion 61 is electrically connected to the head portion 67 that ejects the ink 68. The head drive portion 61 drives piezoelectric elements that are respectively provided in ejection channels of the head portion 67, and causes the ink 68 to be ejected from the nozzles.

The main scanning drive portion 62 includes the drive motor 19 (refer to FIG. 1) and causes the carriage 20 to move in the left-right direction (the main scanning direction). The sub-scanning drive portion 63 includes a motor, gears, and the like (not shown in the drawings), drives the platen drive mechanism 6 (refer to FIG. 1), and causes the platen 5 (refer to FIG. 1) to move in the front-rear direction (the sub-scanning direction).

The agitation motor drive portion 64 drives the agitation motor 44. The pump drive portion 65 drives the pump 751. The operation processing portion 57 outputs, to the CPU 11, operation inputs with respect to the operation buttons 501. The pressure detection sensor 42 detects the pressure inside the hollow space of the hollow member 58, and outputs the detected pressure to the CPU 11. The temperature sensor 66 detects a temperature inside the main tank 30 and outputs the detected temperature to the CPU 11.

The memory device 77 stores data relating to a remaining amount of the ink 68 inside the main tank 30. The data relating to the remaining amount of the ink 68 stored in the memory device 77 is associated with the pressure inside hollow space of the hollow member 58. Therefore, the CPU 11 can detect the remaining amount of the ink 68 in the main tank 30 in accordance with the pressure output by the pressure detection sensor 42. Note that the memory device 77 (refer to FIG. 8) is freely mounted in and removed from a memory mounting portion (not shown in the drawings).

An example of main processing and remaining amount detection processing will be explained with reference to FIG. 9 and FIG. 10. For example, when the power source is switched on, the CPU 11 that is the control device reads out and executes the control program stored in the ROM 12. Note that the control program may be executed when the ink 68 inside the main tank 30 has been depleted. For example, the control program may be executed when maintenance is carried out, or at each of a predetermined period. When the control program is executed, the CPU 11 performs the main processing. The CPU 11 determines whether a print command has been received by operation of the operation buttons 501 (step S1). When the CPU 11 determines that the print command has not been received (no at step S1), the CPU 11 returns the processing to step S1 and stands by for the print command. When the CPU 11 determines that the print command has been received (yes at step S1), the CPU 11 performs remaining amount acquisition processing (step S3).

Figure 10:
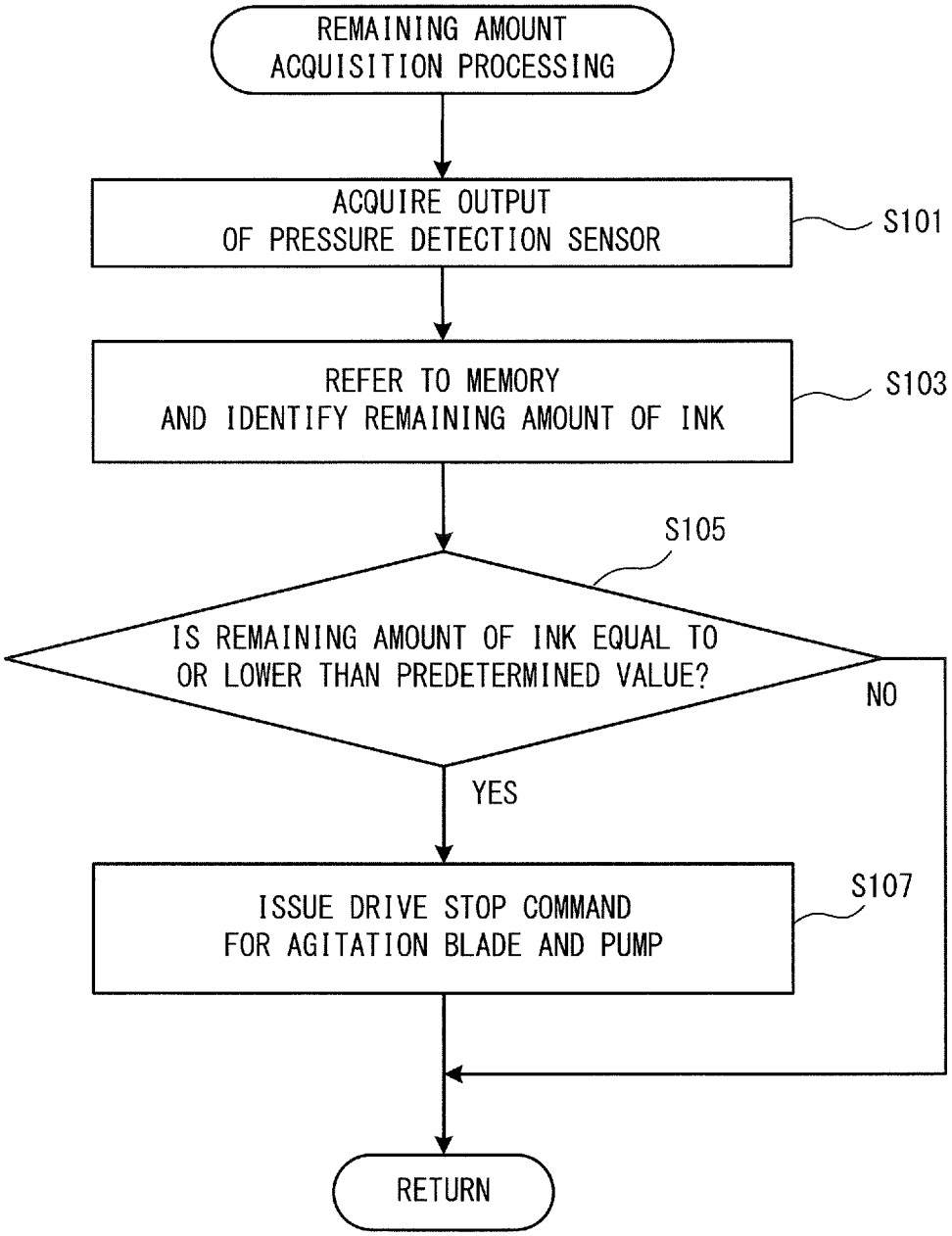
FIG. 10 is a diagram showing a flowchart of remaining amount detection processing.

As shown in FIG. 10, in the remaining amount acquisition processing, the CPU 11 acquires the pressure inside the hollow member 58 from the pressure detection sensor 42 (step S101). The CPU 11 refers to the memory device 77 and identifies the remaining amount of the ink 68 in the main tank 30 in accordance with the acquired pressure (step S103). The CPU 11 determines whether the remaining amount of the ink 68 identified in accordance with the pressure output by the pressure detection sensor 42 is equal to or lower than a predetermined value (step S105). When the CPU 11 determines that the remaining amount of the ink 68 is greater than the predetermined value (no at step S105), the CPU 11 determines that there is no problem with the remaining amount of the ink 68 and returns the processing. The CPU 11 advances the processing to step S5. When the CPU 11 determines that the remaining amount of the ink 68 (refer to a line D in FIG. 4) is equal to or lower than the predetermined value (yes at step S105), the CPU 11 issues a drive stop command to stop the driving of the agitation blade 41 and the pump 751 (step S107). The CPU 11 advances the processing to step S5.

As shown in FIG. 10, the CPU 11 determines whether the drive stop command for the agitation blade 41 and the pump 751 has been received (step S5). When the CPU 11 determines that the drive stop command for the agitation blade 41 and the pump 751 has not been received (no at step S5), the CPU 11 drives the agitation blade 41 (step S7), by driving the agitation motor 44 in the counterclockwise direction in a plan view at a constant rotation speed, for a predetermined period of time following a gradual increase in the rotation speed occurring as a result of starting the driving of the agitation motor 44. In this way, the ink 68 inside the main tank 30 is agitated. Next, the CPU 11 operates the pump 751 (step S9). The CPU 11 controls the pump 751 and causes the ink 68 in the first tube 53 to flow to the outside the main tank 30. In other words, the CPU 11 operates the pump 751 in accordance with the pressure detected by the pressure detection sensor 42. The CPU 11 executes print processing (step S11). The CPU 11 returns the processing to step S1.

On the other hand, when the CPU 11 determines that the drive stop command for the agitation blade 41 and the pump 751 has been received (yes at step S5), the CPU 11 controls the agitation motor 44 and stops the driving of the agitation blade 41 (step S13). By stopping the agitation blade 41 in accordance with the pressure output by the pressure detection sensor 42, the CPU 11 can suppress the air bubbles from being contained in the ink 68. Next, the CPU 11 stops the operation of the pump 751 (step S15). In other words, the CPU 11 stops the pump 751 in accordance with the pressure detected by the pressure detection sensor 42. In this way, the CPU 11 can avoid driving the pump 751 even when the remaining amount of the ink 68 in the main tank 30 is small, and can thus reduce the possibility of the air bubbles entering into the first tube 53. The CPU 11 returns the processing to step S1. In this case, it is preferable that the operator replenish the ink 68 in the main tank 30, and set the printer 1 into a state of being able to perform the printing.

In the printer 1 of the above-described embodiment, the pressure detection sensor 42 is disposed outside the main tank 30 and above the hollow member 58. Therefore, the pressure detection sensor 42 is provided such that it is separated from the ink 68. Therefore, the printer 1 can reduce the possibility of deterioration of the pressure detection sensor 42 due to the ink 68. Thus, the printer 1 can inhibit the deterioration of the pressure detection sensor 42 and can suppress a sensing failure.

The sealing member 24 seal the space between the hollow member and the pressure detection sensor 42. Therefore, the possibility of occurring a space between the pressure detection sensor 42 and the hollow member can be reduced. Thus, the pressure detection sensor can detect the pressure more accurately.

The lower side 21 of the hollow member 58 extends to the orthogonal direction orthogonal to the up-down direction. The opening portion 21A of the hollow member 58 opens toward the orthogonal direction. Since the opening portion 21A opens toward the orthogonal direction, the air bubbles contained in the ink 68 is unlikely to flow into the hollow member 58. Therefore, the pressure detection sensor 42 can recognize the remaining amount of the ink 68 accurately, since the air bubbles are unlikely to flow into the hollow member 58.

The portion, of the hollow member 58, extends to the one side in the orthogonal direction is formed such that the boundary between the air and the ink is positioned inside the portion. Thus, the pressure detection sensor 42 can accurately recognize the remaining amount of the ink 68 in the main tank 30, in comparison with a case in which the lower side 21 of the hollow member 58 does not extend in the horizontal direction.

The opening portion 21A of the hollow member 58 is disposed above the lower end 531 of the first tube 53. Thus, the position of the lower end of the pressure detection sensor 42 that can detect the pressure accurately by the pressure detection sensor 42 is the height of the position of the opening portion 21A. In this position, since the lower end 531 of the first tube 53 is positioned below the position of the ink surface of the ink 68, ink 68 can be certainly drained out from the main tank 30 to the outside.

The fixing member 52 fixes the first tube 53, the second tube 54, and the hollow member 58. Thus, the possibility such the hollow member 58 disposed above the ink surface can be reduced. Further, the first tube 53, the second tube 54, and the hollow member 58 can be fixed more easily, in comparison with a case in which the first tube 53, the second tube 54, and the hollow member 58 are fixed separately by separately provided fixing member.

The position determining member 52A of the fixing member 52 fixes the first tube 53 and the second tube 54 at the left side of the plate-shaped portion 50. The position determining member 52C fixes the hollow member 58 at the right side of the plate-shaped portion 50. Therefore, the possibility can be reduced that an negative impact for detection result of the pressure detection sensor 42 when the ink 68 is flowing out or flowing into the first tube 53 and the second tube 54.

The supply opening portion 33 is provided on left side, and the hollow member 58 is disposed on the right side. Therefore, the supply opening portion 33 and the follow member are kept away from each other, thus, the possibility can be reduced that the air bubbles that is generated when the ink 68 is supplied from the supply opening portion 33 to the main tank 30, flow into the hollow member 58.

Figure 9:
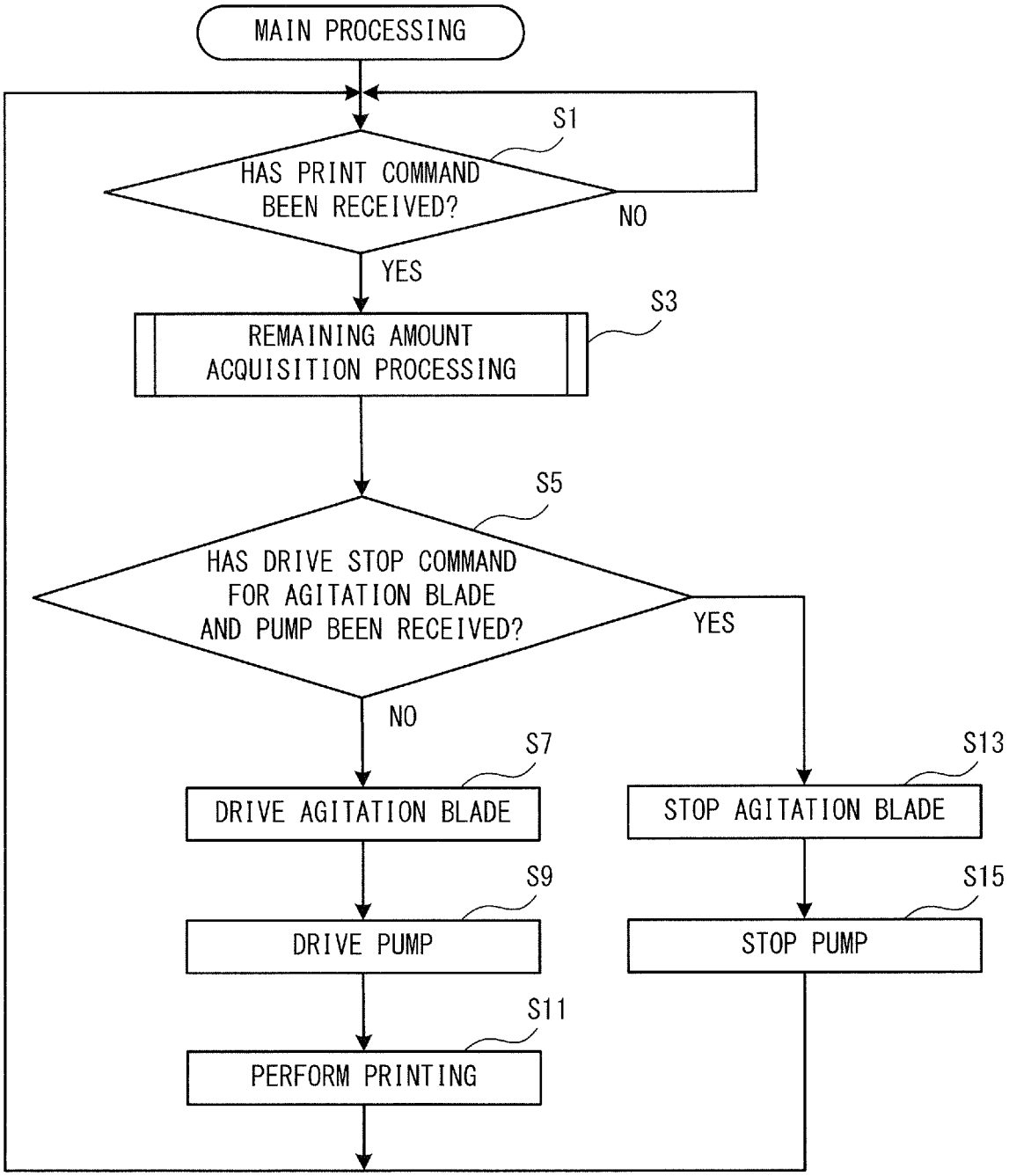
FIG. 9 is a diagram showing a flowchart of main processing.

At the main processing shown in FIG. 9 and the remaining amount acquisition processing shown in FIG. 10, the CPU11 detects the remaining amount of the ink 68 and drives the pump 751 in accordance with this detected remaining amount of the ink 68. Thus, the possibility of driving the pump can be reduced even when there is no ink 68 is left in the main tank 30, for example.

The hollow member 58 is disposed above the agitation blade 41. Thus, the possibility can be reduced that the hollow member 58 prevents the agitation blade 41 from agitating the ink 68.

The agitation blade 41 can rotate in one direction. The lower side 21 of the hollow member 58 extends along the one direction in which the agitation blade rotates, and the opening portion 21A of the hollow member 58 is open toward the one direction. As described above, the direction of the opening portion 21A is forward direction, the opening portion 21A is positioned on left side of the axial line 45 (center line of the shaft 40) of the agitation blade 41, and the rotational direction of the agitation blade 41 is forward direction. Therefore, since the opening direction of the opening portion 21A is turn away from the flowing direction of the ink 68 by the agitation blade 41, the possibility of entering the bubbles into the opening portion 21A can be reduced in comparison with a case in which the opening portion 21A opens toward the rear direction. Further, the pressure inside the hollow member 58 is unlikely to be affected by the affection of the agitation of the ink 68 by the agitation blade 41. Accordingly, the possibility can be reduced that the deterioration of the pressure detection accuracy by the pressure detection portion 42.

The main processing shown in FIG. 9 and the remaining amount acquisition processing shown in FIG. 10, the CPU11 agitates the ink 68 inside the main tank 68 by controlling the agitation blade 41 in accordance with an acquired output from the pressure detection sensor 42. The CPU31 stops driving of the agitation blade 41 in accordance with the acquired output from the pressure detection sensor 42. Thus, the possibility of driving the agitation blade 41 can be reduced even when there is no ink 68 is left in the main tank 30, for example.

The pressure detection sensor 42 detects a gage pressure. The pressure detection sensor 42 of printer 1 can detect the pressure inside the main tank 30 accurately regardless of the atmospheric pressure.

Note that the present disclosure is not limited to the above-described embodiment, and various modifications are possible. The first tube 53 may be configured by two or more components, such as the lower end portion 29 and a main body portion. In this case, the main body portion is provided separately to the lower end portion 29, and is connected to the lower end portion 29. In this way, the leading end portion only of the first tube 53 can be replaced.

Figure 5:
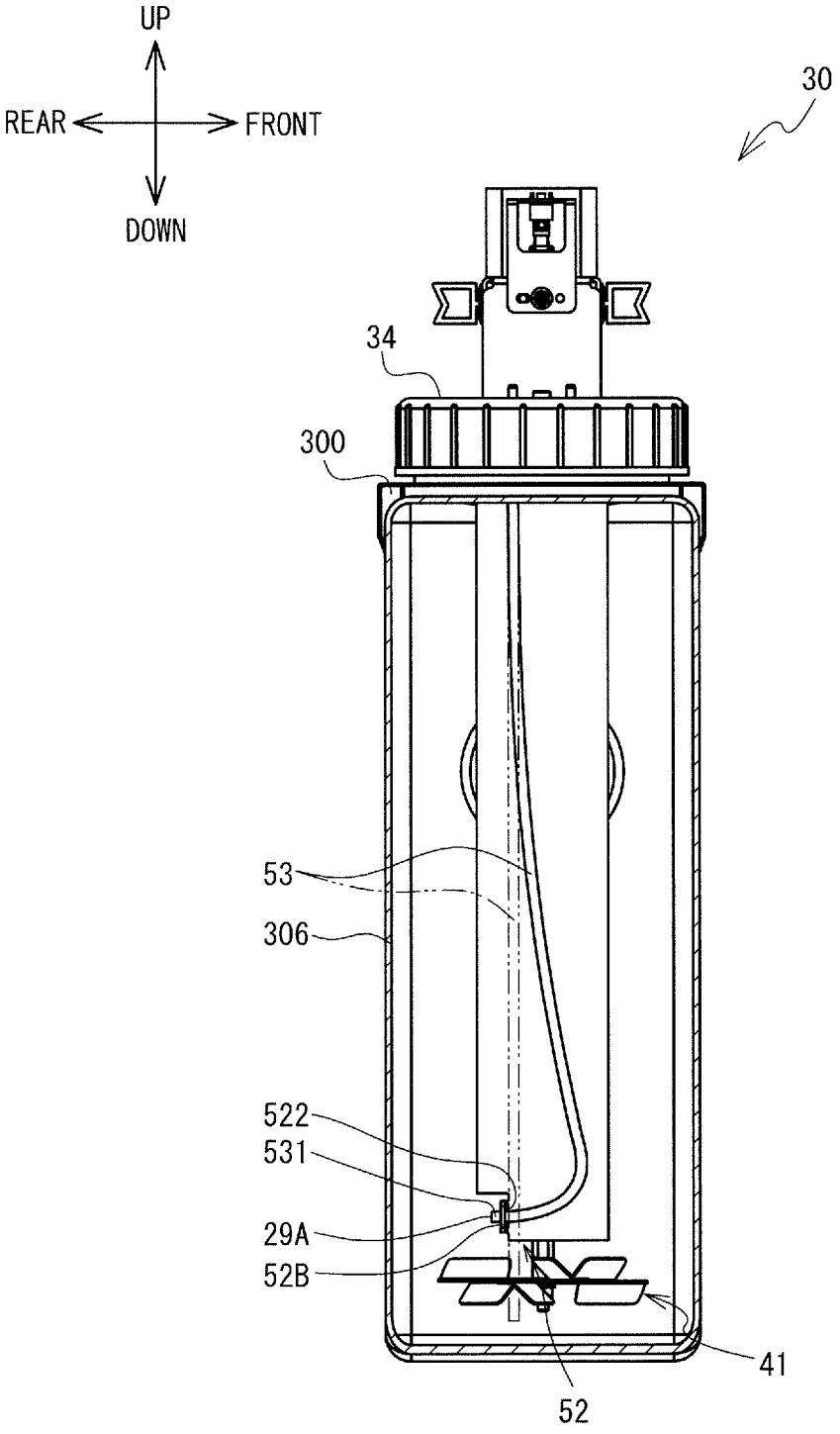
FIG. 5 is a vertical cross-sectional view showing a state before and after attachment of a first tube, along the vertical cross-sectional view shown in FIG. 4.

In the first tube 53, the shape of the section over which the extending direction of the leading end portion and the main body portion changes may be fixed, as shown by the solid lines in FIG. 5, before being attached to the main tank 30. In this case, in the first tube 53 inside the main tank 30, the main body portion may extend in the up-down direction, and the lower end portion 29 other than the main body portion may extend in a direction intersecting the up-down direction. The flow path inside the first tube 53 is stable because the shape is fixed of the section over which the extending direction of the first tube 53 changes. In this way, the printer 1 can smoothly supply the ink 68 to the head portion 67. Thus, the printer 1 can reduce the possibility of the printing becoming faint and patchy as a result of the ink 68 not being ejected from the head portion 67.

Figure 11:
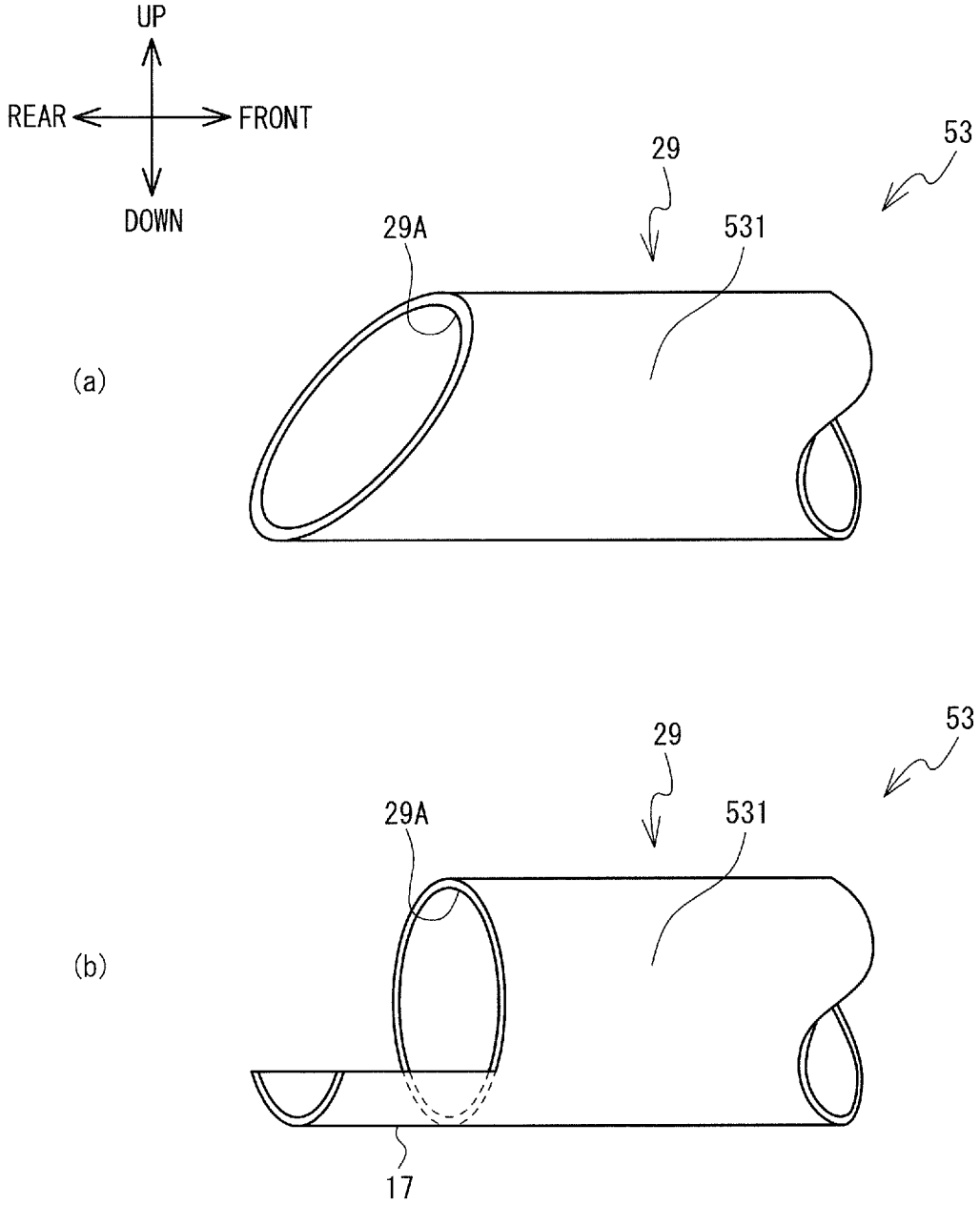
FIG. 11 is the enlarged view in which the lower end portion of the first tube according to a modified example.

The opening portion 29A of the first tube 53 is open in the rearward direction, but is not limited to this example. As shown in FIG. 11(*a*), the opening portion 29A of the lower end portion 29 of the first tube 53 may be open diagonally upward, in the direction intersecting the up-down direction. The air bubbles contained in the ink 68 are likely to move upward, and thus, by the opening portion 29A being open diagonally upward, the printer 1 can reduce the possibility of the air bubbles entering into the first tube 53. Thus, the printer 1 can reduce the possibility of the printing becoming faint and patchy as a result of the ink 68 not being ejected from the head portion 67.

As shown in FIG. 11(*b*), a projecting portion 17 may be provided below the opening portion 29A of the lower end portion 29 of the first tube 53. In the printer 1, the air bubbles contained in the ink 68 sometimes move upward. By providing the projecting portion 17 below the opening portion 29A, the first tube 53 can reduce the possibility of the air bubbles entering into the first tube 53. Thus, the printer 1 can reduce the possibility of the printing becoming faint and patchy as a result of the ink 68 not being ejected from the head portion 67.

The agitation blade 41 agitates the ink 68 by rotating, but is not limited to this example. An agitation member may agitate the ink 68 by reciprocally moving in the up-down direction. The shape of the agitation blade 41 is not limited to the above-described shape and number of blades. It is sufficient that the agitation blade 41 have a shape and number of blades capable of agitating the ink 68. The agitation blade 41 rotates in the clockwise direction in a plan view, which is the forward direction, as shown by arrows in FIG. 6, but is not limited to this example. The agitation blade 41 may rotate in the counterclockwise direction in a plan view, which is a reverse direction. In this case, it is sufficient that the shaft 40 of the agitation blade 41 be a straight line shape that extends in the up-down direction and that the lower end 531 of the lower end portion 29 of the first tube 53 extend in a direction orthogonal to the shaft 40. Thus, in comparison to a case in which the lower end 531 of the lower end portion 29 of the first tube 53 extends in a direction that intersects but is not orthogonal to the shaft 40, or extends in the up-down direction parallel to the shaft 40, the printer 1 can reduce the possibility of the air bubbles entering into the first tube 53. Thus, the printer 1 can reduce the possibility of the printing becoming faint and patchy as a result of the ink 68 not being ejected from the head portion 67.

Similarly, the lower side 21 of the hollow member 58 may extend in the direction orthogonal to the up-down direction, and in the direction orthogonal to the shaft 40. In this way, it is possible to avoid a counterflow of the ink 68 with respect to the opening portion 21A and thus avoid the air bubbles entering into the opening portion 21A. In particular, when the agitation blade 41 rotates in the forward direction and the reverse direction, causing the lower end 531 (the most leading end portion) of the lower end portion 29 of the first tube 53 to extend in the direction orthogonal to the shaft 40, and causing the lower side 21 of the hollow member 58 to extend in the direction orthogonal to the up-down direction contributes to reducing the entry of the air bubbles into the opening portions 21A and 29A. Note that the lower side 21 of the hollow member 58 may extend in a direction intersecting and not orthogonal to the up-down direction, taking into account the rotation direction of the agitation blade 41, the positional relationship with the shaft 40, and characteristics, such as viscosity, of the ink 68.

Further, a part of the lower end portion 29 of the first tube 53 may extend in a direction orthogonal to the one direction in which the agitation blade 41 rotates. Thus, in comparison to a case in which a part of the lower end portion 29 of the first tube 53 extends along the one direction that is the direction in which the agitation blade 41 rotates, the possibility can be reduced that the air bubbles enter into the first tube 53. Thus, the printer 1 can reduce the possibility of the printing becoming faint and patchy as a result of the ink 68 not being ejected from the head portion 67.

The hollow member 58 may extend in the up-down direction, and the opening portion 21A of the hollow member 58 may be open downward. Thus, the hollow member 58 can be easily attached to the main tank 30.

By executing the main processing, the CPU 11 identifies the remaining amount of the ink 68 in the main tank 30 from the output of the pressure detection sensor 42, but is not limited to this example. There is a case in which, due to the ink 68 being introduced into the main tank 30, the pressure inside the hollow space of the hollow member 58 increases by a predetermined amount of pressure. In this case, the CPU 11 may refer to the data relating to the amount of the ink 68 stored in the memory device 77 mounted in the memory mounting portion. When the pressure inside the hollow space of the hollow member 58 has increased by the predetermined amount of pressure due to the ink 68 being introduced into the main tank 30, the printer 1 can refer to the data relating to the amount of the ink 68 stored in the memory device 77 mounted in the memory mounting portion, and can detect the remaining amount of the ink 68. In addition to this, the detection of the remaining amount of the ink 68 in the main tank 30 may be performed by interrupt processing performed at a predetermined time interval.

For example, in addition to the printer 1, the main tank 30 may be provided in a liquid storage device having an ejection portion that ejects a liquid recording material onto a recording medium, by spraying or the like. The present disclosure is particularly effective when the liquid recording material has high settleability. The liquid recording material is not limited to ink, and may be a discharge agent, a pretreatment agent, or the like. The main tank 30 is not limited to the above-described shape, and it is sufficient that the main tank 30 be capable of storing the ink 68.

A first modified example will be explained with reference to FIG. 12. Any of the configuration that is not particularly described or illustrated is the same as the configuration relating to FIG. 1 to FIG. 10. In the printer 1 of the modified example shown in FIG. 12, a point of difference is that a fixing member 252 is provided in place of the fixing member 52 of the above-described embodiment. The fixing member 252 is provided with a plate-shaped portion 50A, position determining members 252A, 252B, and 252C, inclined surfaces 115A, 115B, and 115C, openings 521A, 523A, and 524A, and the like.

Figure 12:
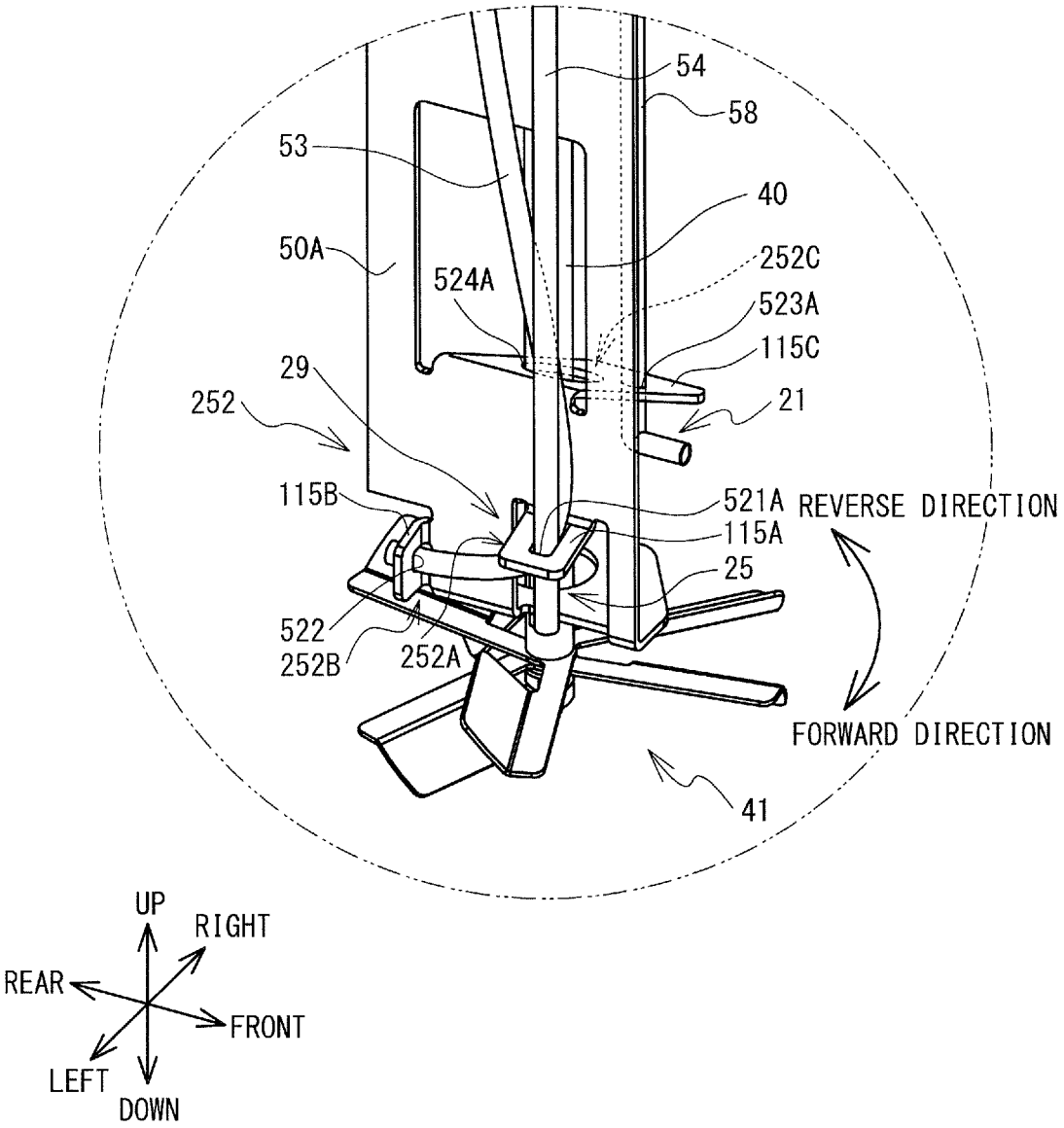
FIG. 12 is an enlarged view in which the lower end portion that is inside the main tank according to a first modified example.

As shown in FIG. 12, the position determining members 252A, 252B, and 252C of the fixing member 252 are provided on the plate-shaped portion 50A, and are disposed higher than the agitation blade 41. The opening 521A of the position determining member 252A is formed in the inclined surface 115A that is a surface whose leading end side (left side) is inclined downward with respect to the horizontal direction. The opening 522 of the position determining member 252B is formed in the vertical surface, and the inclined surface 115B on the upper end of the vertical surface is a surface whose leading end side (left side) is inclined downward with respect to the horizontal direction. The openings 523A and 524A of the position determining member 252C are formed in the inclined surface 115C that is a surface whose leading end side (right side) is inclined downward with respect to the horizontal direction. The openings 521A, 522, 523A, and 524A penetrate in a direction orthogonal to the surfaces of the inclined surfaces 115A, 115B, and 115C.

A component of the ink 68 in the main tank 30 may accumulate on the inclined surfaces 115A, 115B, and 115C of the position determining members 252A, 252B, and 252C, however the component of the accumulated ink 68 tend to fall off due to the weight itself of the component of the ink 68, since the leading end portion of the inclined surfaces 115A, 115B, and 115C inclined downward direction. Therefore, the component of the ink 68 is more likely to fall from the inclined surfaces 115A, 115B, and 115C than when the surfaces of the position determining members 252A, 252B, and 252C are horizontal surfaces (refer to FIG. 6), and the ink 68 that falls is more likely to be agitated by the agitation blade 41. Thus, the possibility is reduced of the printing becoming faint and patchy as a result of the ink 68 not being ejected from the head portion 67.

A second modified example will be explained with reference to FIG. 13. A point of difference is that a fixing member 352 is provided in place of the fixing member 52 of the above-described embodiment. The fixing member 352 is provided with a plate-shaped portion 50B, position determining members 352A, 252B, and 352C, and the like. The position determining member 352A includes a horizontal portion 215A and an inclined surface 315A. The position determining member 352C includes a horizontal portion 215B and an inclined surface 315B. The horizontal portions 215A and 215B have the same shape as each of the position determining members 52A and 52C shown in FIG. 6. Note that the position determining member 252B is the same as the position determining member 252B of the modified example shown in FIG. 12.

Figure 13:
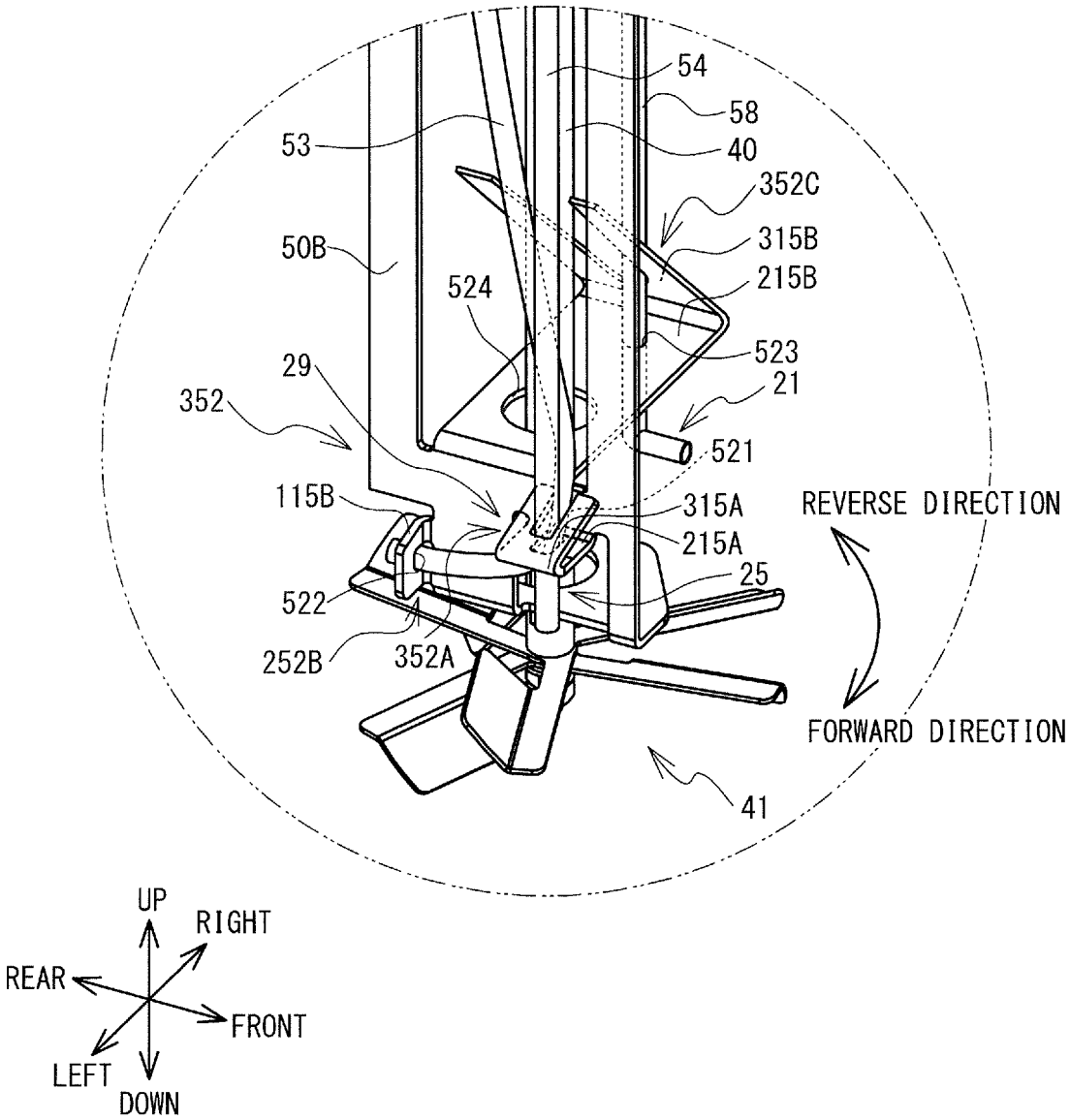
FIG. 13 is an enlarged view in which the lower end portion that is inside the main tank according to a second modified example.

As shown in FIG. 13, the position determining member 352A is disposed higher than the agitation blade 41. The position determining member 352A includes the horizontal portion 215A in which the opening 521 is formed, and the inclined surface 315A that extends upward and to the right from the left end of the horizontal portion 215A and that is inclined downward from the right side to the left side. The upper end side of the inclined surface 315A is split into two parts, and the first tube 53 and the second tube 54 are inserted between the two parts. The opening 521 penetrates the horizontal portion 215A so as to be orthogonal to the horizontal portion 215A.

Similarly to the configuration shown in FIG. 6 described above, the horizontal position of the lower end portion 29 of the first tube 53 is regulated by the opening 521 of the horizontal portion 215A of the position determining member 352A. Further to the leading end side (the lower side) of the first tube 53 than the position regulated by the horizontal portion 215A of the position determining member 352A, the vertical position of the first tube 53 is regulated by the position determining member 252B. As shown in FIG. 5, even when the shape is not fixed of the section over which the extending direction of the leading end portion of the first tube 53 changes, the horizontal position of the first tube 53 is regulated by the cross section of the opening 521 of the horizontal portion 215A of the position determining member 352A, and thus in comparison to a case in which the position is regulated using a surface that is not horizontal, an operation to determine the position in the horizontal direction can be easily performed. Similarly, even when the shape is not fixed of the section over which the extending direction of the leading end portion of the first tube 53 changes, the vertical position of the first tube 53 is regulated by the cross section of the opening 522 of the vertical surface of the position determining member 252B, and thus, in comparison to a case in which the position is regulated using a surface that is not vertical, an operation to determine the position in the vertical direction can be easily performed.

Further, similarly to the configuration in FIG. 12 described above, the inclined surfaces 315A and 315B that are the inclined surfaces are disposed above the openings 521 and 523 that determine the positions of the first tube 53, the second tube 54, and the hollow member 58. Even if the component of the ink 68 accumulates on the inclined surfaces 315A and 315B, there is a possibility that the component of the ink 68 accumulated on the inclined surfaces may fall off due to the weight itself of the accumulated component of the ink 68.

Alternatively, when the agitation blade 41 rotates, the component of the ink 68 accumulated on the inclined surfaces is more likely to fall than when the accumulation surfaces are the horizontal surfaces. The possibility is thus reduced of the accumulated component of the ink 68 not being agitated by the agitation blade 41, and, as a result, the possibility is reduced of the component of the ink 68 not being appropriately agitated by the agitation blade 41. Thus, in comparison to the configuration as shown in FIG. 6, the possibility is reduced of the printing becoming faint and patchy as a result of the ink 68 not being ejected from the head portion 67.

In the above-described first modified example and second modified example, the component of the ink 68 is, for example, a pigment, and the first and second modified examples are particularly effective in the case of the white ink. In this case, the component of the white ink is a pigment relating to titanium oxide. Further, the horizontal surfaces of the position determining members 52A, 52B, and 52C are higher than the agitation blade 41, and the accumulated component of the ink 68 is thus disposed above the agitation blade 41. The first modified example and the second modified example are effective even in a case in which the accumulated component of the ink 68 is not agitated by the agitation blade 41 even when the agitation blade 41 rotates, and the ink 68 is not appropriately agitated by the agitation blade 41.

The fixing members 252 and 352 of the first modified example and the second modified example are disposed higher than the agitation blade 41, and include the inclined surfaces 115A, 115B, 115C, 315A, and 315B that are inclined downward with respect to the up-down direction. Even if the component of the ink 68 in the main tank 30 has accumulated on the fixing member 52, in comparison to a case in which the component of the ink 68 or the like does not fall off from the fixing member 52, when the component of the ink 68 falls off from the fixing member 52, the possibility is increased of the component of the ink 68 being appropriately agitated by the agitation blade 41. Thus, the printer 1 can reduce the possibility of the printing becoming faint and patchy as a result of the ink 68 not being ejected from the head portion 67.

Figure 14:
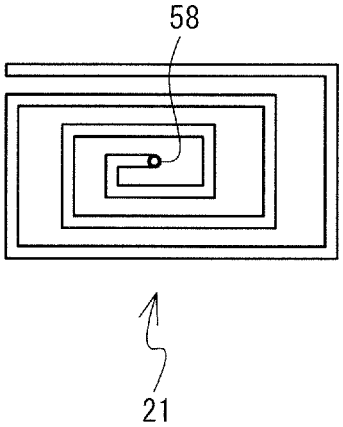
FIG. 14 is a plan view of the hollow member according to a modified example.
Figure 14:
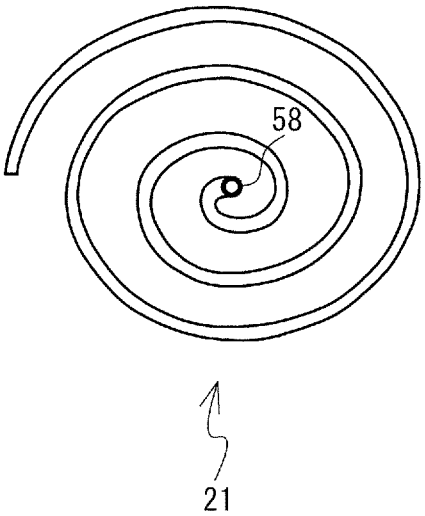

As shown in FIG. 14A and FIG. 14B, the horizontal section of the lower side 21 of the hollow member 58 may have a spiral shape and may be made longer. In order to facilitate introduction of the liquid into the horizontal section of the lower side 21 of the hollow member 58, the opening portion 21A may be made wider than an inside flow path.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An image formation device comprising:

a tank configured to store ink;

a hollow member disposed inside the tank, and extending in an up-down direction; and a sensor disposed outside the tank and above the hollow member, and configured to detect a pressure inside the hollow member, wherein a lower side of the hollow member extends in an intersecting direction that intersects to the up-down direction, wherein both an upper end side portion of lower side and a lower end side portion of the lower side extend in the intersecting direction, the upper end side portion being a portion of the hollow member, and the lower end side portion being a portion of the hollow member, and wherein an inner surface of the upper end side portion of the lower side and an inner surface of the lower end side portion of the lower side face each other in the up-down direction.

2. The image formation device according to claim 1, further comprising:

a sealing member configured to seal a space between the hollow member and the sensor.

3. The image formation device according to claim 1, wherein the lower side of the hollow member extends to one side in an orthogonal direction orthogonal to the up-down direction, and an opening portion of the lower side of the hollow member is open toward the one side in the orthogonal direction.

4. The image formation device according to claim 3, wherein a portion, of the hollow member, extending to the one side in the orthogonal direction is formed to maintain a position of a boundary between an air and the ink inside the portion.

5. The image formation device according to claim 1, further comprising:

a first tube configured to cause the ink to flow from the tank to the outside the tank, wherein an opening portion of the hollow member is disposed above a lower end of the first tube.

6. The image formation device according to claim 5, further comprising:

a second tube configured to cause the ink to flow from the outside the tank into the tank; and a fixing member provided inside the tank, and configured to fix the first tube, the second tube, and the hollow member.

7. The image formation device according to claim 6, wherein the fixing member is configured to fix the first tube and the second tube on the one side in an orthogonal direction orthogonal to the up-down direction, and to fix the hollow member on another side in the orthogonal direction.

8. The image formation device according to claim 1, further comprising:

a supply opening portion provided on one side of the tank in a horizontal direction, and configured to supply the ink to the tank, wherein the hollow member is disposed on another side in the horizontal direction.

9. The image formation device according to claim 1, further comprising:

a pump configured to flow the ink inside the tank to the outside the tank;

a processor; and a memory storing computer-readable instructions that, when executed by the processor, perform processes comprising:

detecting a remaining amount of the ink in accordance with the pressure detected by the sensor; and driving the pump in accordance with the detected remaining amount of the ink.

10. The image formation device according to claim 1, further comprising:

an agitation blade provided inside the tank, and configured to agitate the ink, wherein the hollow member is disposed above the agitation blade.

11. The image formation device according to claim 10, wherein the agitation blade is configured to rotate in one direction, the lower side of the hollow member extends along the one direction in which the agitation blade rotates, and an opening portion of the hollow member is open toward the one direction.

12. An image formation device comprising:

a tank configured to store ink;

a hollow member disposed inside the tank, and extending in an up-down direction;

a sensor disposed outside the tank and above the hollow member, and configured to detect a pressure inside the hollow member;

an agitation blade provided inside the tank, and configured to agitate the ink;

a processor; and a memory storing computer-readable instructions that, when executed by the processor, perform processes comprising:

agitating the ink inside the tank by controlling the agitation blade in accordance with an acquired output from the sensor; and stopping driving of the agitation blade in accordance with the acquired output from the sensor.

13. The image formation device according to claim 1, wherein the sensor is configured to detect a gage pressure.

14. The image formation device according to claim 1, wherein the intersecting direction is orthogonal to the up-down direction.

* * * * *